US010923849B2

(12) United States Patent
Hayakawa

(10) Patent No.: US 10,923,849 B2
(45) Date of Patent: Feb. 16, 2021

(54) CONNECTOR

(71) Applicant: J.S.T. Mfg. Co., Ltd., Tokyo (JP)

(72) Inventor: Yoshinori Hayakawa, Yokohama (JP)

(73) Assignee: J.S.T. MFG. CO., LTD., Osaka (JP)

( * ) Notice: Subject to any disclaimer, the term of this patent is extended or adjusted under 35 U.S.C. 154(b) by 0 days.

(21) Appl. No.: 16/789,306

(22) Filed: Feb. 12, 2020

(65) Prior Publication Data

US 2020/0266569 A1 Aug. 20, 2020

(30) Foreign Application Priority Data

Feb. 18, 2019 (JP) ..... JP2019-026237

(51) Int. Cl.
*H01T 13/40* (2006.01)
*H01R 13/436* (2006.01)

(52) U.S. Cl.
CPC ..... *H01R 13/4365* (2013.01)

(58) Field of Classification Search
CPC ..... H01R 13/4362; H01R 13/41; H01R 13/4223; H01R 13/6215
USPC .. 439/752.5, 595, 362–364, 594, 598, 733.1
See application file for complete search history.

(56) References Cited

U.S. PATENT DOCUMENTS 6,582,242 B2 * 6/2003 Murakami ..... H01R 13/5219 439/271
7,481,674 B2 * 1/2009 Murakami ..... H01R 13/5219 439/587
8,992,251 B2 * 3/2015 Smutny ..... H01R 31/08 439/595
9,929,506 B2 * 3/2018 Hashimoto ..... H01R 13/58
9,948,025 B2 * 4/2018 Hashimoto ..... H01R 13/426
2010/0041272 A1 * 2/2010 Morello ..... H01R 13/4223 439/595
2014/0287621 A1 * 9/2014 Smutny ..... H01R 31/08 439/574

FOREIGN PATENT DOCUMENTS

JP 2002-324613 A 11/2002

* cited by examiner

*Primary Examiner* — Phuong Chi Thi Nguyen
(74) *Attorney, Agent, or Firm* — Kratz, Quintos & Hanson, LLP

(57) ABSTRACT

A connector includes a housing including an accommodation passage and a retainer insertion space, and a retainer including an insertion wall extending along the connector mating direction and a locking claw protruding from a rear portion thereof toward an accommodation passage direction. In the housing, a locking protrusion is provided at a rear portion of the retainer insertion space. When the retainer is inserted into the retainer insertion space from a connector mating front side, the locking claw gets over the locking protrusion to be engaged therewith, and thus a pre-locked position at which detachment of the retainer to the front side is prevented is obtained. When the retainer is moved in a widthwise direction, a full-locked position at which the locking claw engages with a step in the rear portion of the connector terminal, and detachment of the connector terminal toward the rear side is prevented is obtained.

5 Claims, 14 Drawing Sheets

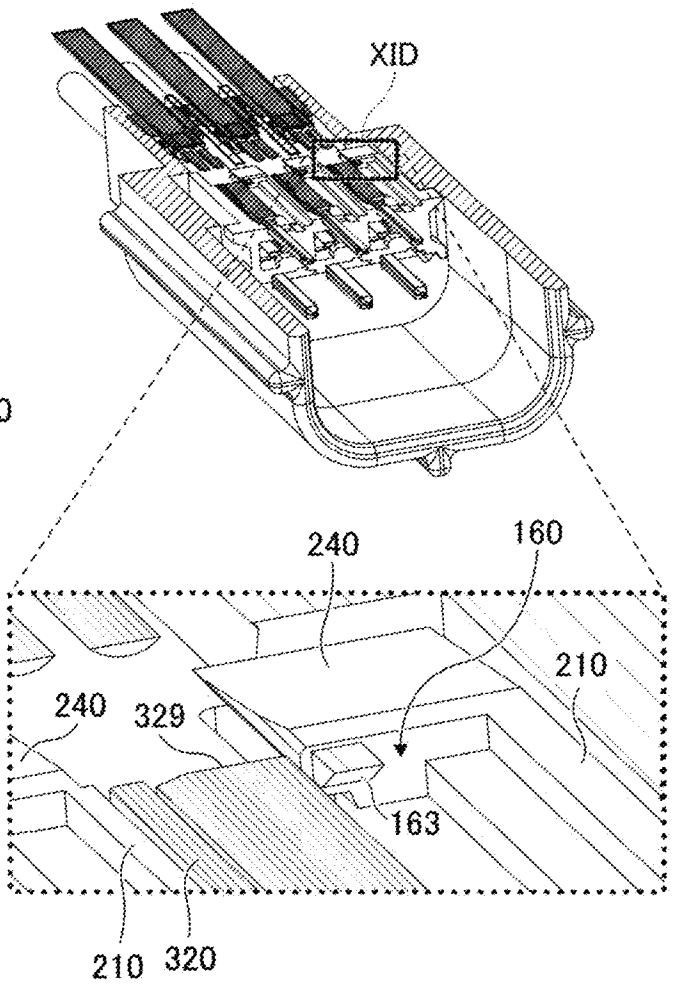
FIG.11C
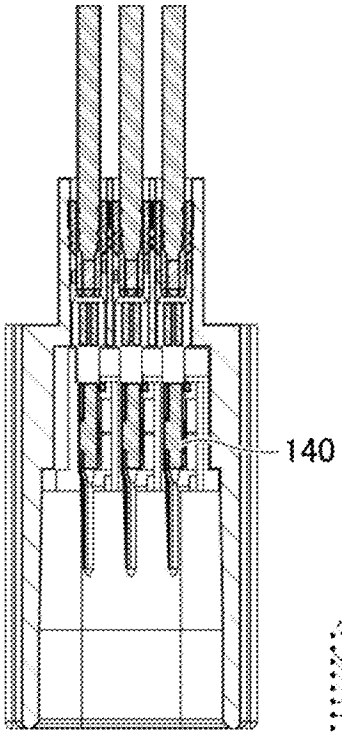
FIG.11B
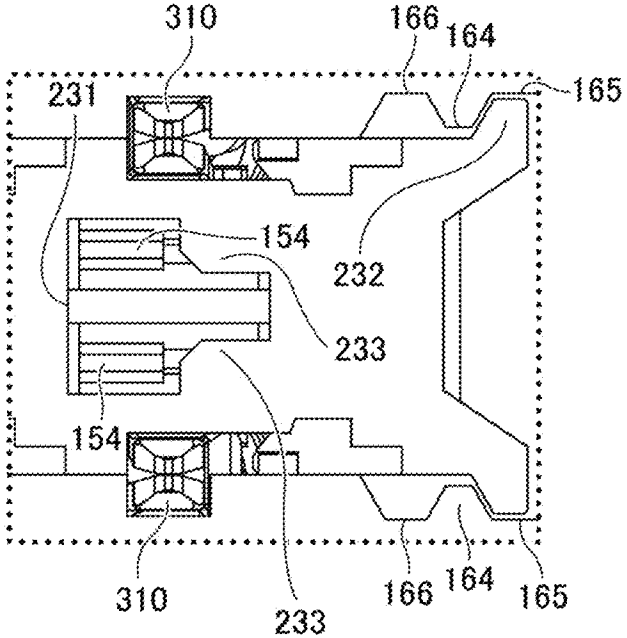
FIG.11A
FIG.11D

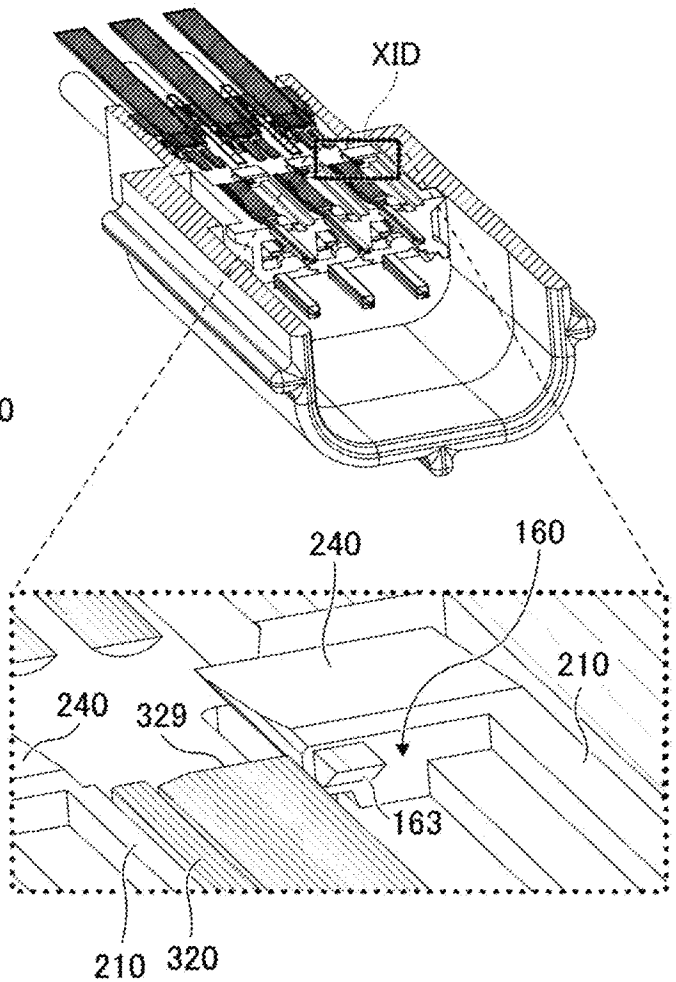
FIG.14C
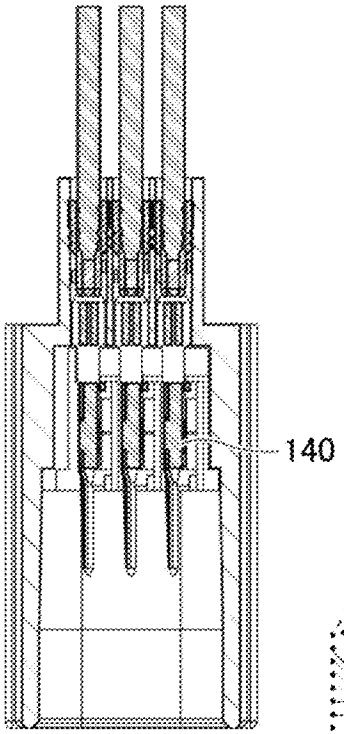
FIG.14B
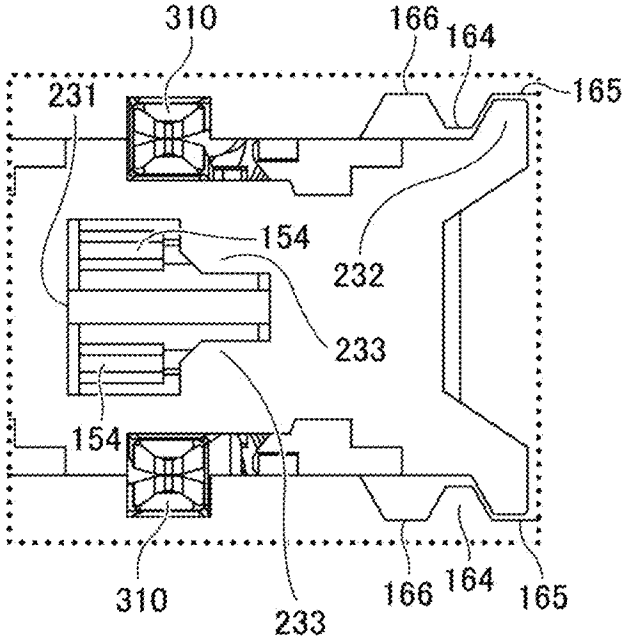
FIG.14A
FIG.14D

CONNECTOR

BACKGROUND

Technical Field

The present invention relates to a connector, and more particularly to a connector including a terminal position assurance (TPA) member, or a retainer for maintaining an engaged state of a connector terminal.

Related Art

JP 2002-324613 A discloses a connector capable of employing a side-type retainer without providing a side aperture in a connector housing. In this connector, a connector housing having a cavity for accommodating a terminal is divided into an outer housing and an inner housing. The inner housing has a lance structure for locking a terminal and a structure for attaching a retainer. The retainer is assembled to the inner housing from the side at a pre-locked position, and then the assembly is assembled to the outer housing from the front side. The side-type retainer thus can be worked.

SUMMARY

However, the connector having the structure disclosed in JP 2002-324613 A has a problem in that the inner housing is required in order for attaching the retainer to the connector housing, and thus the number of parts increases.

The present invention provides a connector capable of incorporating a side type retainer into a housing from a mating front side without increasing the number of parts other than the housing and the retainer and without providing an aperture on the side of the housing.

According to an aspect of the present invention, a connector includes a housing including an accommodation passage configured to extend along a connector mating direction and accommodate a connector terminal, and a retainer insertion space configured to communicate with the accommodation passage in a widthwise direction and open to a connector mating front side; and a retainer including an insertion wall configured to extend along the connector mating direction so as to correspond to a shape of the retainer insertion space, and a locking claw configured to protrude from a rear portion of the insertion wall with respect to the connector mating direction toward the accommodation passage, wherein the housing is provided with a locking protrusion configured to protrude in a vertical direction at a rear portion of the retainer insertion space with respect to the mating direction, when the retainer is inserted from the connector mating front side into the retainer insertion space, the locking claw gets over the locking protrusion to be engaged therewith, and thus a pre-locked position at which detachment of the retainer to the front side with respect to the mating direction is prevented is obtained, and when the connector terminal is inserted into the accommodation passage from the rear side with respect to the mating direction, and then the retainer is moved in the widthwise direction, a full-locked position at which the locking claw of the retainer engages with a step formed in the rear of the connector terminal with respect to the connector mating direction, and detachment of the connector terminal toward the rear side with respect to the mating direction is prevented is obtained.

According to another aspect of the present invention, in the aspect of the invention, at least one of the locking claw and the locking protrusion has elasticity.

According to yet another aspect of the present invention, in the aspect of the invention, the locking claw has a shape that tapers toward the rear side with respect to the connector mating direction, and/or the locking protrusion has an inclined surface on the front side with respect to the connector mating direction.

According to still another aspect of the present invention, in the aspect of the invention, the housing includes a lance in the accommodation passage, the lance extending along the connector mating direction, being engaged with a locking portion formed in the front side of the connector terminal accommodated in the accommodation passage, with respect to the connector mating direction, and being capable of bending toward the vertical direction, the insertion wall of the retainer includes a restriction protrusion configured to protrude toward the widthwise direction of the connector, and when the retainer is at the pre-locked position, bending of the lance toward the vertical direction is not restricted in a manner that the restriction protrusion is not at a position of the lance in the vertical direction, and when the retainer is at the full-locked position, bending of the lance toward the vertical direction is restricted in a manner that the restriction protrusion is at the position of the lance in the vertical direction.

According to still yet another aspect of the present invention, in the aspect of the invention, an insertion opening is provided on a mating front side of the retainer for allowing an insertion of a tool for releasing locking between the locking portion of the connector terminal and the lance, and a closing portion is formed in the insertion opening for preventing the insertion of the tool by closing a mating front side of the restriction protrusion.

According to the present invention, it is possible to incorporate a side type retainer into a housing from a mating front side without increasing the number of parts other than the housing and the retainer and without providing an aperture on the side of the housing.

According to the other aspect of the present invention, it is possible to easily insert the retainer into the housing from the mating front side of the housing, and to prevent the retainer from falling off the housing.

According to the other aspect of the present invention, in a case where the retainer is at a pre-locked position, the lance can freely bend. Thus, it is possible to detach the connector terminal from the housing. In a case where the retainer is in a full-locked state, it is not possible to bend the lance, and thus it is not possible to detach the connector terminal from the housing.

According to the other aspect of the present invention, it is possible to inhibit the lance from disengaging the connector terminal therefrom when the retainer is at the full-locked position.

BRIEF DESCRIPTION OF DRAWINGS

FIG. 10C is further taken along XD-XD line and is obliquely viewed.

FIG. 11A is a partially enlarged view of XIA of FIG. 10A, FIG. 11B is a cross-sectional view along XIB-XIB line in FIG. 10A, FIG. 11C is a cross-sectional perspective view when FIG. 11B is obliquely viewed, and FIG. 11D is a partially enlarged view of a D portion of FIG. 11C.

FIG. 13C is further taken along XIIID-XIIID line and is obliquely viewed.

FIG. 14A is a partially enlarged view of XIVA of FIG. 13A. FIG. 14B is a cross-sectional view along XIVB-XIVB line in FIG. 13A. FIG. 14C is a cross-sectional perspective view when FIG. 14B is obliquely viewed. FIG. 14D is a partially enlarged view of a XIVD portion of FIG. 14C.

DEIAILED DESCRIPTION

A connector 10 according to an embodiment will be described with reference to FIGS. 1 to 6. The following embodiment describes an example of the connector 10 according to the present invention, and does not intend to limit the present invention to the connector 10. The embodiment can also be applied to connectors in other forms described in claims.

Figure 1:
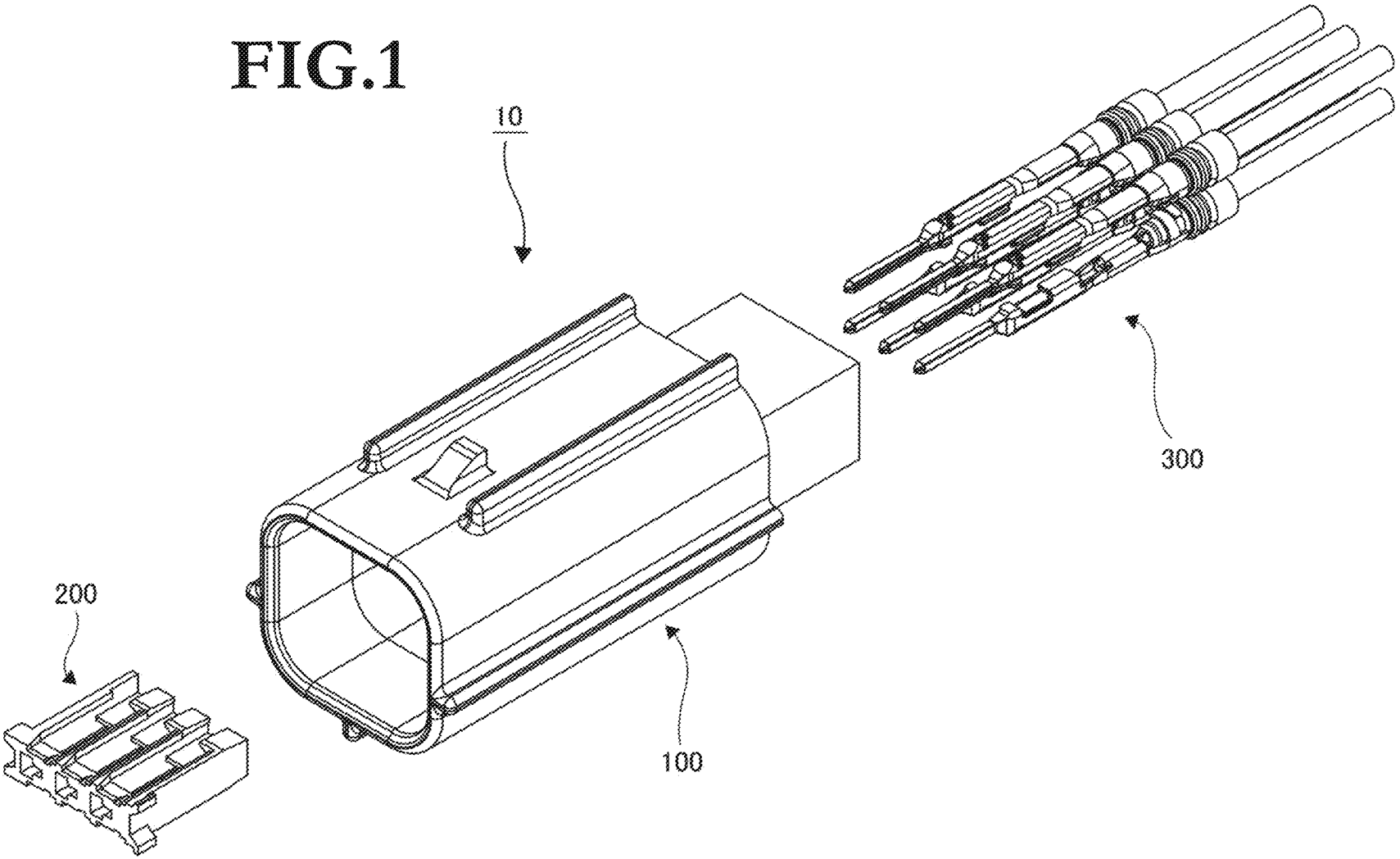
FIG. 1 is an external perspective view illustrating a connector according to an embodiment.

FIG. 1 is an external perspective view illustrating the connector 10 in the embodiment. As illustrated in FIG. 1, the connector 10 includes a housing 100, a retainer (terminal position assurance member) 200, and a connector terminals 300. As will be described in detail later, the connector terminal 300 is attached to the housing 100 from the rearward with respect to a mating direction. The retainer 200 is inserted into the housing 100 from a mating front side, that is, from the frontward side with respect to the mating direction. Thus, the retainer 200 prevents the connector terminal 300 attached to the housing 100 from falling off the housing 100. When the connector is assembled, firstly, the retainer 200 is inserted into the housing 100 (pre-locked position) from the frontward side with respect to the mating direction. Then, the connector terminal 300 is inserted into the housing 100 from the rear side with respect to the mating direction, and a pre-locked state is made. Then, the retainer 200 is moved in a widthwise direction orthogonal to the mating direction, and comes to a pre-locked position. In this manner, a full-locked state is made where it is not possible for the connector terminal 300 to fall off the housing 100.

In the following description, a direction in which the connector terminals 300 extend, that is, a direction along which the connector 10 in the embodiment is mated to a complementary connector (not illustrated) is referred to as the "mating direction". In FIG. 1, a side on which the housing 100 is mated with the complementary connector, that is, a side from which the retainer 20C) is inserted is referred to as a "mating front side" or a "front side" with respect to the mating direction. A side on which the connector terminal 300 is inserted into the housing 100 is referred to as a "ear side" with respect to the mating direction. A direction orthogonal to a horizontal direction of the mating direction is referred to as a "widthwise direction". A direction further perpendicular to the widthwise direction is referred to as a "vertical direction".

Figure 2:
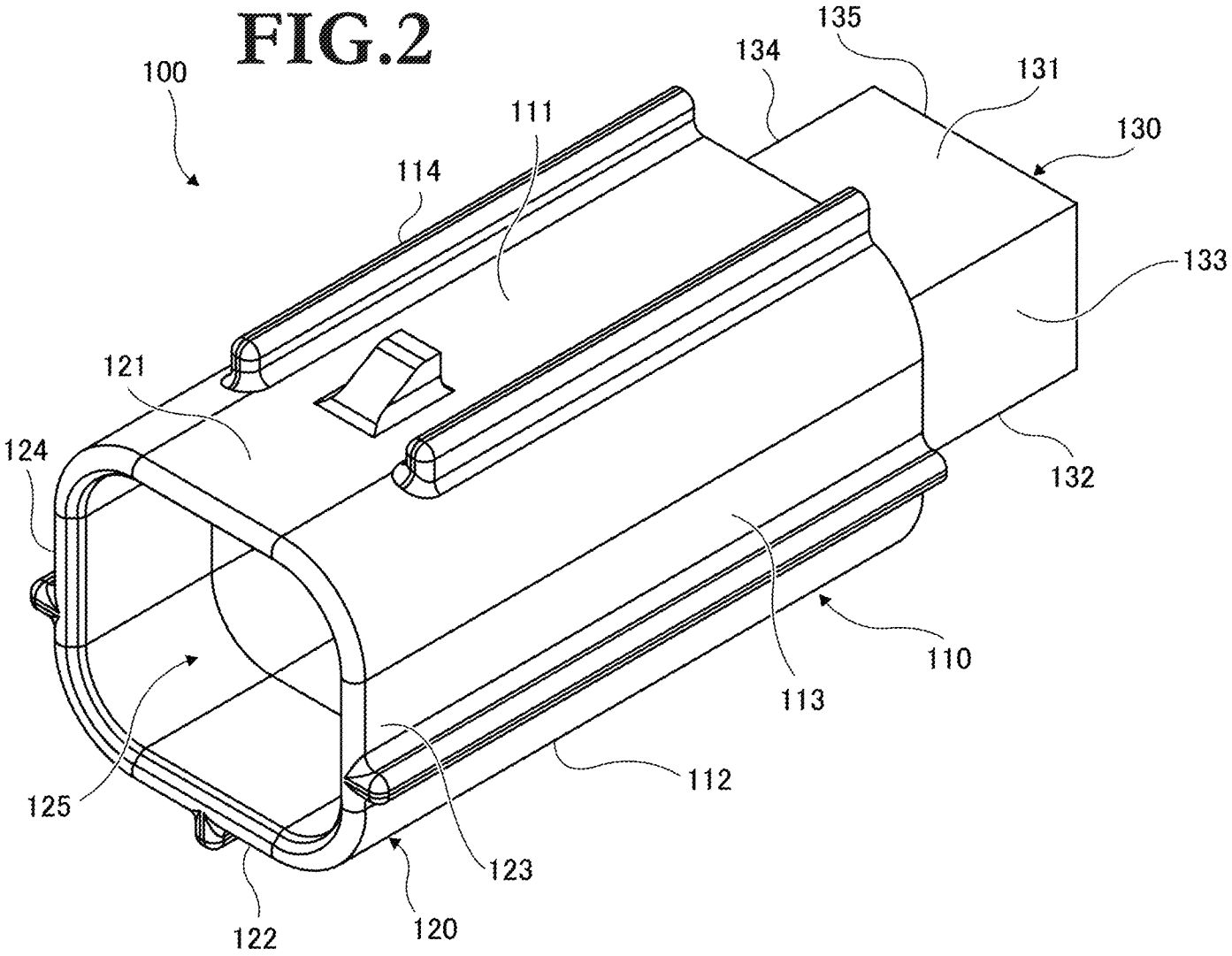
FIG. 2 is an external perspective view illustrating a housing.
Figure 3A:
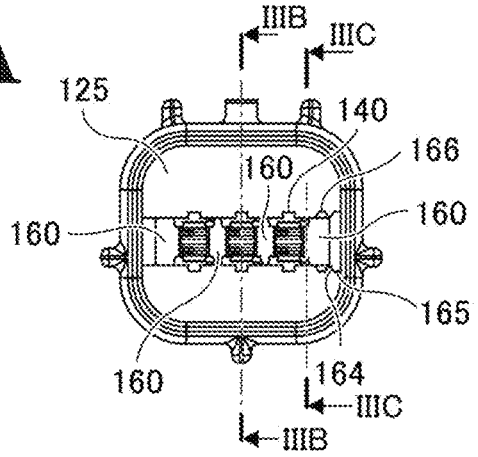
FIG. 3A is a front view when the housing is viewed from a mating front side.
Figure 3B:
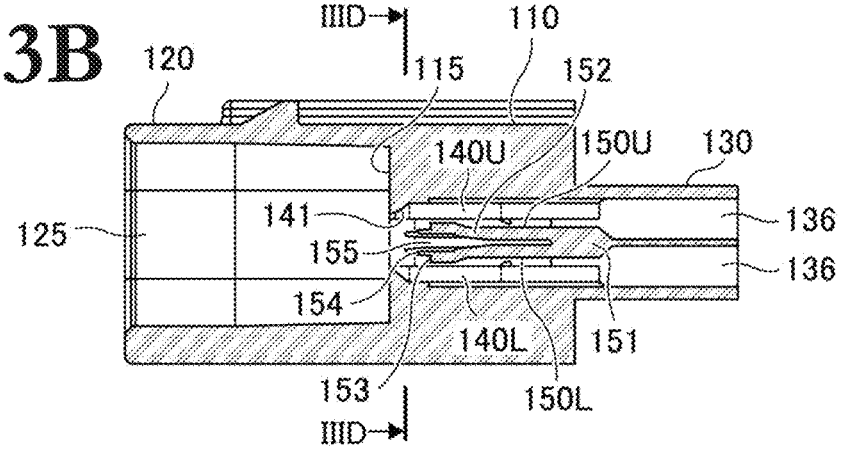
FIG. 3B is a side cross-sectional view when taken along IIIB-IIIB line in FIG. 3A.
Figure 3C:
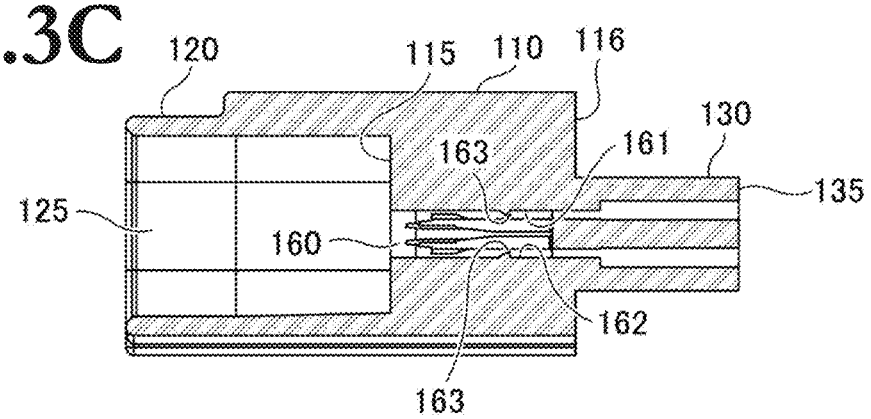
FIG. 3C is a side cross-sectional view when taken along IIIC-IIIC line in FIG. 3A.
Figure 3D:
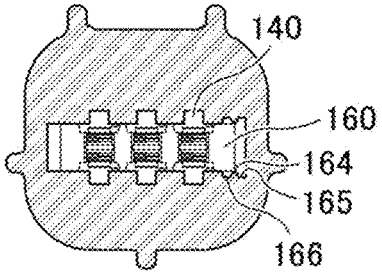
FIG. 3D is a cross-sectional view when taken along IIID-IIID line in FIG. 3B.

FIG. 2 is an external perspective view illustrating the housing 100. FIG. 3A is a front view when the housing is viewed from a mating front side. FIG. 3B is a side cross-sectional view when taken along IIIB-IIIB line in FIG. 3A. FIG. 3C is a side cross-sectional view when taken along line in FIG. 3A. FIG. 3D is a cross-sectional view when taken along line in FIG. 3B.

As illustrated in FIGS. 2, 3B, and 3C, the housing 100 includes a housing main body 110, a hood 120, and a terminal holder 130. The housing 100 is made of an insulating resin. The housing main body 110 has a rectangular parallelepiped shape which has a predetermined length with respect to the mating direction, a predetermined width with respect to the widthwise direction, and a predetermined height with respect to the vertical direction. The housing main body 110 has an upper surface 111, a lower surface 112, a right side surface 113, a left side surface 114, a mating front surface 115, and a housing main body rear surface 116. The housing main body 110 is substantially square or rectangular when viewed from the mating front side. However, the shape of the housing main body 110 is not limited thereto but can be a circular shape, an elliptical shape, or the like.

As illustrated in FIGS. 3A, 3B, and 3D, in the housing main body 110, terminal accommodation passage 140 extending along the mating direction for accommodating the connector terminal 300 is formed to penetrate from the mating front surface 115 to the housing main body rear surface 116. In the embodiment, six terminal accommodation passages 140 in total, that is, three in the widthwise direction and two in the vertical direction are formed. In the following description, terminal accommodation passages 140 located on an upper side is referred to as a "terminal accommodation passage 140U" while the terminal accommodation passages 140 located on a lower side is referred to as a "terminal accommodation passage 140L" for distinguishment. Further, the terminal accommodation passages 140 are simply referred to as a "terminal accommodation passage 140" when the terminals are collectively referred. The shape of the terminal accommodation passage 140 corresponds to a shape of box portion and a connection portion of the connector terminal 300.

As illustrated in FIG. 3B, the front side of the terminal accommodation passage 140 in the mating direction is inclined so as to be narrowed in the vertical direction in the immediate vicinity of the mating front surface 115 of the housing main body 110. Specifically, the terminal accommodation passage 140U located on the upper side has an accommodation passage inclined surface 141 inclined downward at the immediate vicinity of the mating front surface 115. The terminal accommodation passage 140L located on the lower side has an accommodation passage inclined surface 141 inclined upward at the immediate vicinity of the mating front surface 115. When the connector terminal 300 described later is accommodated in a terminal accommodation passage 140, a box inclined surface of the box portion comes into contact with the accommodation passage inclined surface 141. Thus, the connector terminal 300 does not move further forward along the mating direction.

As illustrated in FIG. 3B, the upper terminal accommodation passage 140U and the lower terminal accommodation passage 140L are separated by two lances 150. That is, two lances 150 are formed between the terminal accommodation passages 140U, 140L. The lance 150 extends along the mating direction, is capable of bending in the vertical direction, and is engaged with a front locking step (locking portion) formed at the front portion of the connector terminal 300, as described later, accommodated in the terminal accommodation passage 140 along the mating direction.

An upper lance 150U is provided immediately below the upper terminal accommodation passage 140U, and a lower lance 150L is provided immediately above the lower terminal accommodation passage 140L. The upper lance 150U and the lower lance 150L each extends in a manner to form a cantilever shape toward the mating front surface 115 along an extending direction of the terminal accommodation passage 140 from a lance base 151 of the housing main body 110 on the housing main body rear surface 116 side. The upper lance 150U and the lower lance 150L are capable of bending in the vertical direction. Since the upper lance 150U and the lower lance 150L have the same shape and are arranged so as to be symmetrical with respect to the horizontal plane, each lance will simply be referred to as a "lance 150" in the following description.

Each lance 150 includes an elastic arm 152, a lance locking protrusion 153, and a thin operation piece 154. The elastic arm 152 extends from the lance base 151 toward the mating front surface 115. The lance locking protrusion 153 is formed at the distal end of the elastic arm 152. The thin operation piece 154 further extends toward the mating front surface 115 from the distal end of the lance locking protrusion 153. The lance locking protrusion 153 gently protrudes upward toward the front side with respect to the mating direction in the case of the upper lance 150U, and gently protrudes downward toward the front side with respect to the mating direction in the case of the lower lance 150L. Then, the front side of the lance locking protrusion 153 in the side of the mating direction has a step cut off extending in the widthwise direction and the vertical direction.

An inter-lance gap 155 is formed between the upper lance 150U and the lower lance 150L adjacent to each other in the vertical direction. When the restriction protrusion of the retainer 200 described later is not inserted into the inter-lance gap 155, the upper lance 150U and the lower lance 150L can be bent upward or downward in the vertical direction by the elastic force of the elastic arm 152.

Further, as illustrated in FIGS. 3A, 3C, and 3D, in the housing main body 110, a retainer insertion space 160 is formed in parallel to the terminal accommodation passage 140. The retainer insertion space 160 communicates with each terminal accommodation passage 140 in the widthwise direction and opens toward the mating front surface 115. The retainer insertion space 160 is provided in order for inserting the insertion wall of the retainer 200 described later there into. The retainer insertion space 160 is not vertically separated by the lance 150 but communicates in the vertical direction.

Further, as illustrated in FIG. 3C, in the housing 100, a locking protrusion 163 is provided in the rear portion of the retainer insertion space 160 in the mating direction. The locking protrusion 163 protrudes from an insertion space upper surface 161 and an insertion space lower surface 162 in the vertical direction. The locking protrusion 163 has an inclined surface on the front side in the mating direction, and makes it easy for a locking claw of the retainer 200 described later to move over the locking protrusion 163 and move backward along the mating direction.

Further, as illustrated in FIGS. 3A and 3D, a pre-lock groove 165 and a full-lock groove 166 are formed in one retainer insertion space 160 (in the embodiment, the retainer insertion space 160 on the rightmost side in the widthwise direction) of the housing main body 110. The pre-lock groove 165 and a full-lock groove 166 are separated by an intermediate protrusion 164 on the upper and lower surfaces. The pre-lock groove 165 is located outside the retainer insertion space 160 (that is, the rightmost side in the widthwise direction). The full-lock groove 166 is located inside the retainer insertion space 160. The intermediate protrusion 164, the pre-lock groove 165, and the full-lock groove 166 may be formed in the retainer insertion space 160 on the left side in the widthwise direction.

As illustrated in FIGS. 2, 3B, and 3C, the hood 120 of the housing 100 is a tubular portion formed on the mating front side of the housing main body 110. The hood 120 includes an upper wall 121, a lower wall 122, a right side wall 123, and a left side wall 124. The upper wall 121 is the upper surface 111 of the housing main body 110 extending from the mating front surface 115 as it is beyond the mating front side (frontward with respect to the mating direction). Similarly, the lower wall 122, the right side wall 123, and the left side wall 124 are, respectively, the lower surface 112, the right side surface 113, and the left side surface 114 of the housing main body 110 extending beyond the mating front surface 115 (frontward with respect to the mating direction). The inside of the hood 120 is hollow, and serves as a fitting opening 125 that receives a complementary connector (not illustrated).

The terminal holder 130 of the housing 100 is a rectangular parallelepiped member formed to protrude rearward from the housing main body rear surface 116 of the housing main body 110 with respect to the mating direction. As illustrated in FIG. 2, the terminal holder 130 has an outer shape which is slightly smaller than the housing main body 110. The terminal holder 130 has a holder upper surface 131, a holder lower surface 132, a holder right side surface 133, a holder left side surface 134, and a holder rear surface 135. As illustrated in FIG. 3B, a plurality of terminal inlets 136 are provided in the terminal holder 130 to penetrate the holder rear surface 135 from the housing main body rear surface 116. The number of the terminal inlets 136 is equal to the number of the terminal accommodation passages 140 formed in the housing main body 110. In the embodiment, three terminal inlets 136 are formed with respect to the widthwise direction and two terminal inlets 136 are formed with respect to the vertical direction. Each terminal inlet 136 communicates with the terminal accommodation passage 140 of the housing main body 110. The size of each terminal inlet 136 is larger than the terminal accommodation passage 140 and is as large as the size that can accommodate and hold a wire of the connector terminal 300 described later.

Figure 4A:
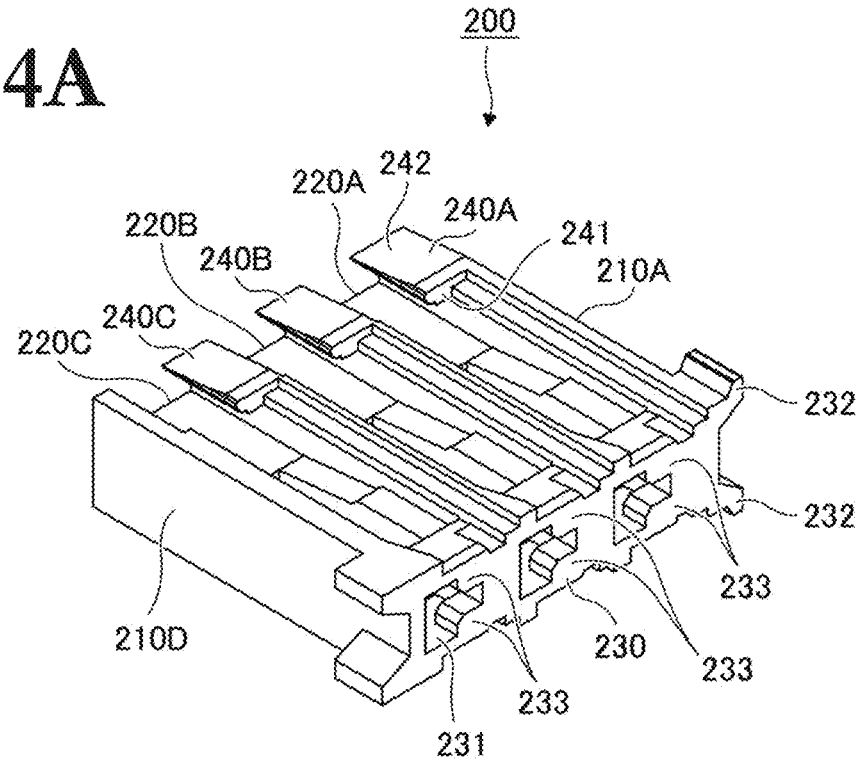
FIG. 4A is an external perspective view when a retainer is viewed from a front left side in a mating direction.
Figure 4B:
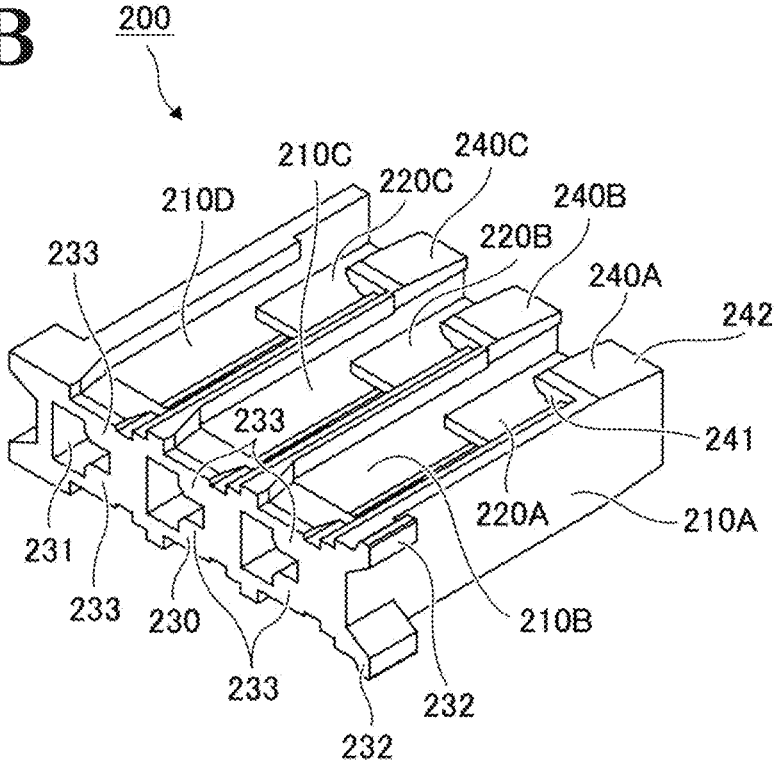
FIG. 4B is an external perspective view when the retainer is viewed from a front right side in the mating direction.
Figure 5A:
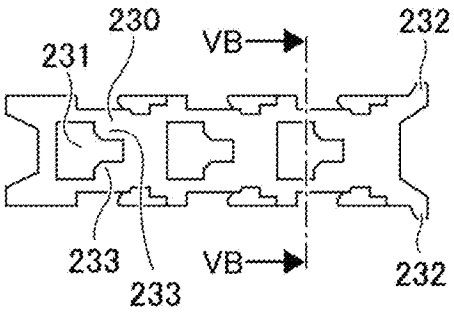
FIG. 5A is a front view illustrating the retainer
Figure 5B:
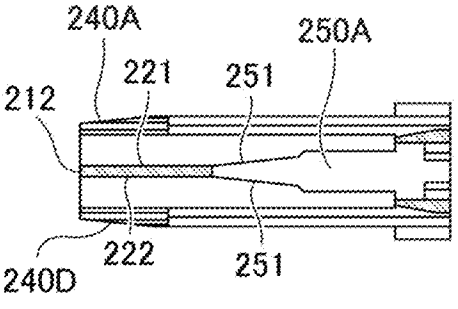
FIG. 5B is a cross-sectional view when the retainer is taken along VB-VB line in FIG. 5A.
Figure 5C:
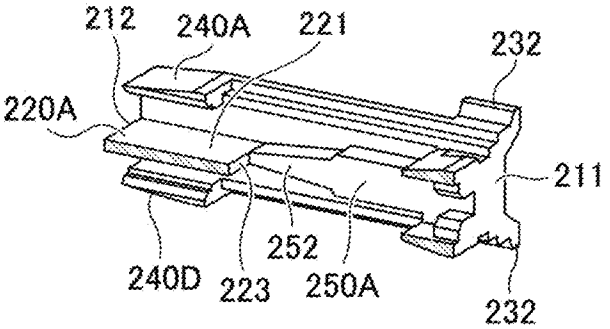
FIG. 5C is a cutout perspective view when the retainer is taken along VB-VB line in FIG. 5A and is viewed from the front right side in the mating direction.
Figure 5D:
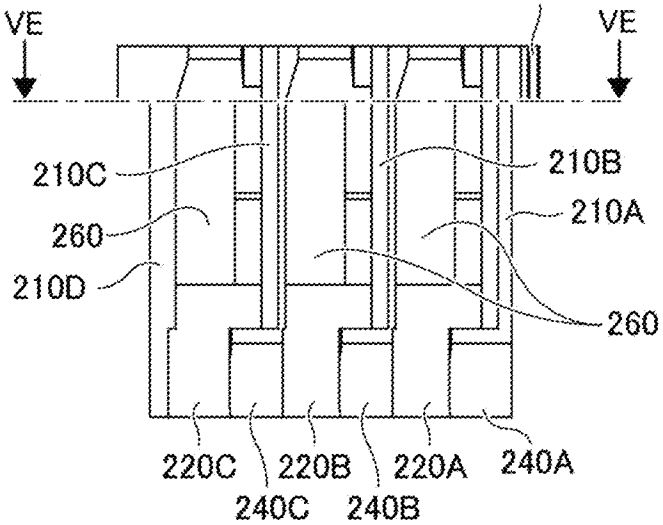
FIG. 5D is a plan view when the retainer is viewed from above.
Figure 5E:
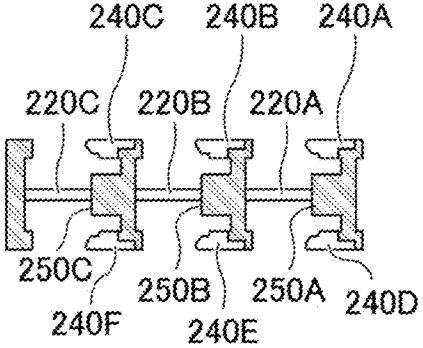
FIG. 5E is a cross-sectional view when the retainer is taken along VE-VE line in FIG. 5D and is viewed from the front side with respect to the mating direction.
Figure 5F:
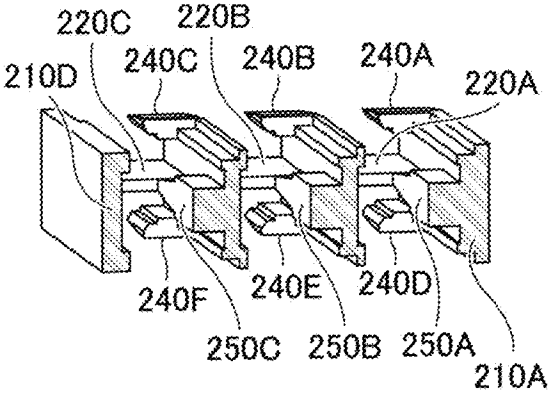
FIG. 5F is cutout perspective view when the retainer is taken along VE-VE line in FIG. 5D and is viewed from the front side with respect to the mating direction.

Next, the retainer 200 in the embodiment will be described with reference to FIGS. 4A to 5F. FIG. 4A is an external perspective view when a retainer 200 is viewed from a front left side in a mating direction. FIG. 4B is an external perspective view when the retainer 200 is viewed from a front right side in the mating direction. FIG. 5A is a front view illustrating the retainer. FIG. 5B is a cross-sectional view when the retainer is taken along VB-VB line in FIG. 5A. FIG. 5C is a cutout perspective view when the retainer is taken along VB-VB line in FIG. 5A and is viewed from the front right side in the mating direction. FIG. 5D is a plan view when the retainer is viewed from above. FIG. 5E is a cross-sectional view when the retainer is taken along VE-VE line in FIG. 5D and is viewed from the front side with respect to the mating direction. FIG. 5F is cutout perspective view when the retainer is taken along VE-VE line in FIG. 5D and is viewed from the front side with respect to the mating direction.

The retainer 200 includes four insertion walls 210A, 210B, 210C, 210D (collectively referred to as "insertion walls 210"), three horizontal connection plates 220A, 220B, 220C, and a front plate 230. The insertion walls 210A to 210D extend along the mating direction with corresponding to the shape of the retainer insertion space 160 described above. The horizontal connection plates 220A to 220C connect the four insertion walls 210 at the rear side with respect to the mating direction. The front plate 230 connects the four insertion walls 210 at the front side with respect to the mating direction.

The height of each insertion wall 210 is substantially equal to the height of the retainer insertion space 160 formed in the housing main body 110. Thus, the insertion wall 210 can be inserted into the retainer insertion space 160. The width of each insertion wall 210 is smaller than the width of the retainer insertion space 160. For example, the width of each insertion wall 210 is about one half of the width of the corresponding retainer insertion space 160. With this configuration, each insertion wall 210 is movable in the retainer insertion space 160 in the widthwise direction, that is, between a pre-locked position and a full-locked position described later.

Further, the horizontal connection plates 220 are connected to the center portions of the insertion walls 210 in the vertical direction such that the adjacent insertion walls 210 face each other with being spaced from the retainer insertion space 160 of the housing main body 110 at the same interval. Each horizontal connection plate 220 connect adjacent other insertion walls 210 at the center portion of the insertion wall 210 in the mating direction, specifically, over about two-thirds from the front end 211 to the rear end 212 of the insertion wall 210. Each horizontal connection plate 220 has a connection plate upper surface 221, a connection plate lower surface 222, and a connection plate front end 223.

When viewed from the front side with respect to the mating direction, locking claws 240A to 240F protruding leftward in the widthwise direction are formed at the rear portions of the upper and lower ends of the three insertion walls 210A to 210C located on the right side. The three locking claws 240A to 240C located on the upper side have the same shape. The three locking claws 240D to 240F located on the lower side have the same shape. The three upper locking claws 240A to 240C and the three lower locking claws 24013 to 240F are planar-symmetrical with respect to the horizontal connection plate 220.

That is, each locking claw 240 protrudes toward the terminal accommodation passage 140 at the rear portion of each insertion wall 210 along the mating direction. That is, when each insertion wall 210 is inserted into the retainer insertion space 160 from the mating front surface 115 of the housing main body 110 toward the rear side along the mating direction, the locking claw 240 protrudes toward the widthwise direction by a predetermined width to a position having an extent that the locking claw does not reach the rear portion of the terminal accommodation passage 140 (which communicates with the retainer insertion space 160 in the widthwise direction) in the mating direction.

Each locking claw 240 includes a locking surface 241 having a front side with respect to the mating direction, which is perpendicular to the mating direction, and a tapered surface 242 inclined so as to approach the horizontal connection plate 220 from the end portion of the locking surface 241 far from the horizontal connection plate 220 toward the rear side with respect to the mating direction. That is, each locking claw 240 has a shape that tapers toward the rear side along the mating direction. When the retainer 200 moves rearward along the mating direction, the inclined surface of the locking protrusion 163 and the tapered shape of the locking claw 240 described above make it easy for the locking claw 240 to move over the locking protrusion 163 and move along the mating direction. However, any one of the inclined surface of the locking protrusion 263 and the tapered shape of the locking claw 240 may be provided.

When viewed from the mating front side, restriction protrusions 250A to 250C are formed on the three insertion walls 210A to 210C located on the right side thereof, that is, the three insertion walls 210 on which the locking claws 240 are formed. The restriction protrusions 250A to 250C have a shape protruding from the center portions of the left side surface of the insertion wall 210A to 210C (when viewed from the front side with respect to the mating direction) along the mating direction toward the left side in the widthwise direction over the front side with respect to the mating direction. The protruding width of the restriction protrusions 250A to 250C with respect to the widthwise direction is substantially the same as the protruding width of the above-described locking claw 240 with respect to the widthwise direction. Each restriction protrusion 250 is formed to connect the front plate 230 with the connection plate front end 223 of the horizontal connection plate 220. The restriction protrusion 250 includes upper and lower inclined surfaces 251 and a restriction protrusion side surface 252. The upper and lower inclined surfaces 251 are inclined to gradually become thicker from the rear side along the mating direction toward the front side. The restriction protrusion side surface 252 expands between the upper and lower inclined surface 251 and is parallel to the insertion wall 210.

Therefore, when viewed from the front side with respect to the mating direction, the lance receiving space 260 in which the vertical direction penetrates between the restriction protrusion side surface 252 of the restriction protrusion 250 of the insertion wall 210 located on the right side and the insertion wall 210 located on the left side of the restriction protrusion side surface 252. The lance receiving space 260 receives the lance 150 when the retainer 200 is incorporate into the housing main body 110.

A tool insertion opening 231 is formed on the front side of the lance receiving space 260 with respect to the mating direction, in the front plate 230 formed on the front side of the retainer 200. When the retainer 200 is at the pre-locked position, the tool insertion opening 231 allows an insertion of the tool for releasing the locking between the front locking step (locking portion) described later of the connector terminal 300 and the lance locking protrusion 153 of the lance 150. The tool insertion opening 231 is narrowed at the upper and lower sides on the insertion wall side with respect to the widthwise direction, or a closed portion 233 is formed where the mating front side of the restriction protrusion 250 is closed, thereby the insertion of the tool is prevented.

A locking protrusion 232 protruding outward toward the vertical direction is formed on the right side with respect to the widthwise direction of the front plate 230 of the retainer 200. The shape of the locking protrusion 232 is a shape fit to the pre-lock groove 165 or the full-lock groove 166 when the insertion wall 210 of the retainer 200 is inserted into the retainer insertion space 160 of the housing main body 110 of the housing 100. If the intermediate protrusion 164, the pre-lock groove 165, and the full-lock groove 166 of the housing 100 are formed on the left side with respect to the widthwise direction of the housing 100, the locking protrusion 232 is correspondingly provided on the left side with respect to the widthwise direction of the front plate 230 of the retainer 200.

Figure 6A:
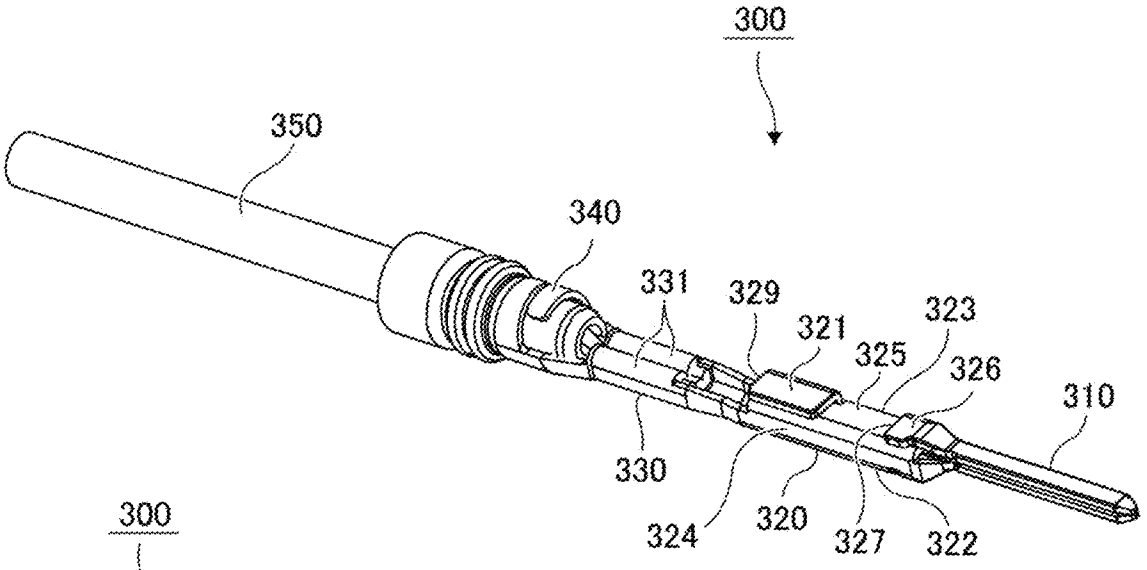
FIG. 6A is an external perspective view illustrating a connector terminal in the embodiment.
Figure 6B:
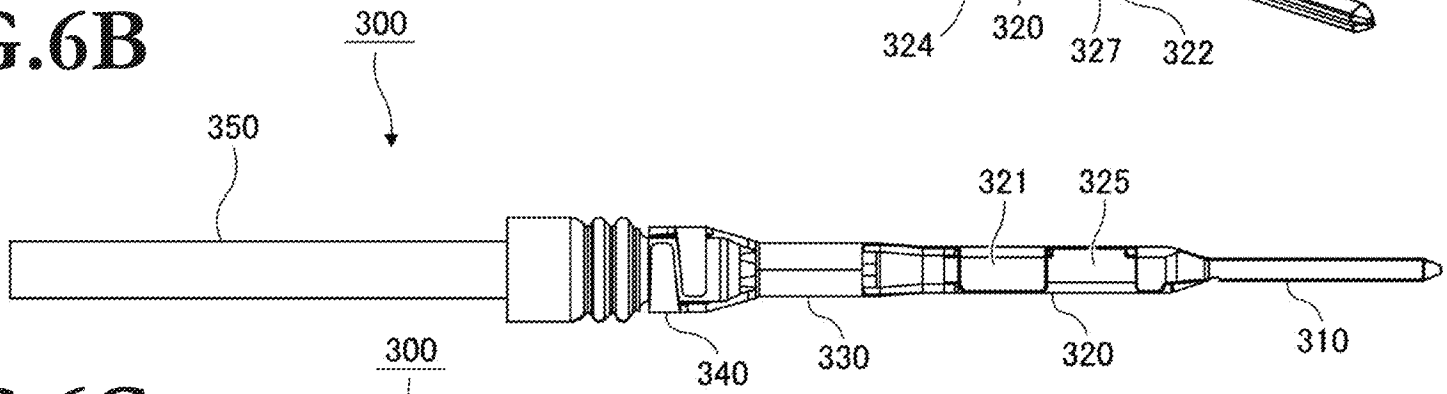
FIG. 6B is a plan view illustrating the connector terminal in FIG. 6A.
Figure 6C:
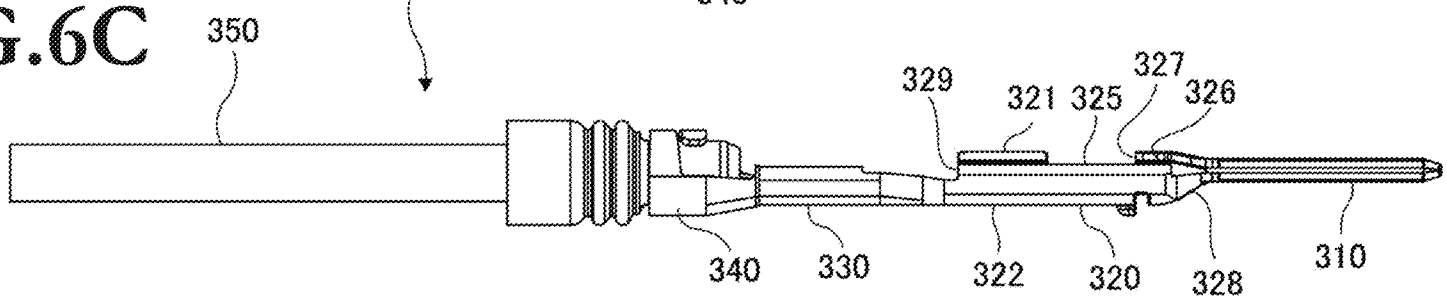
FIG. 6C is a side view illustrating the connector terminal in FIG. 6A.

Next, the connector terminal 300 of the embodiment will be described with reference to FIGS. 6A to 6C. FIG. 6A is an external perspective view illustrating a connector terminal 300 in the embodiment. FIG. 6B is a plan view illustrating the connector terminal 300 in FIG. 6A. FIG. 6C is a side view illustrating the connector terminal 300 in FIG. 6A.

The connector terminal 300 includes a contact 310, a box portion 320, a connection portion 330, and a gripping portion 340. The connector terminal 300 is formed by punching a single metal plate. The contact 310 is a long rod-like member formed by closely folding a metal plate, and has a form of a male contact in the embodiment. When the connector terminal 300 is attached to the housing 100, the contact 310 protrudes forward from the terminal accommodation passage 140 of the housing main body 110 along the mating direction and extends into the fitting opening 125.

The box portion 320 is a member formed by folding the metal plate into a rectangular tube shape. The box portion 320 includes a box upper surface 321, a box lower surface 322, a box right side surface 323, and a box left side surface 324. The height of the box portion 320 with respect to the vertical direction is substantially equal to the height of the terminal accommodation passage 140 of the housing main body 110. The width of the box portion 320 with respect to the widthwise direction is substantially equal to the width of the terminal accommodation passage 140 of the housing main body 110.

A box upper surface recess portion 325 formed by cutting out a portion of the metal plate is formed in the center portion of the box upper surface 321 with respect to the mating direction. A tall portion 326 which remains tall because the above-described metal plate is not cut is formed on the front side of the box upper surface recess portion 325 with respect to the mating direction. A front locking step 327 is formed between the box upper surface recess portion 325 and the tall portion 326.

As illustrated in FIG. 6C, the contact 310 is formed to be slightly eccentric toward the box upper surface 321 side. An inclined box surface 328 which is inclined from the box lower surface 322 to the contact 310 is formed in the front portion of the box lower surface 322 in the mating direction and a transition portion of the contact 310.

The connection portion 330 of the connector terminal 300 extends the box right side surface 323 and the box left side surface 324 of the box portion 320 toward the rear side with respect to the mating direction. The connection portion 330 is crimped and connected in a state where the conductor of a wire 350 is embedded inside by two crimping pieces 331. The connection portion 330 has a lower height than the box portion 320. A rear-side locking step 329 having a height which changes abruptly is formed between the connection portion 330 and the box portion 320.

A gripping portion 340 is formed at the rear side of the connection portion 330 of the connector terminal 300 with respect to the mating direction. The gripping portion 340 clamps the wire 350 by being held around the coating. As a result, the wire 350 is fixed to the connector terminal 300.

Figure 7:
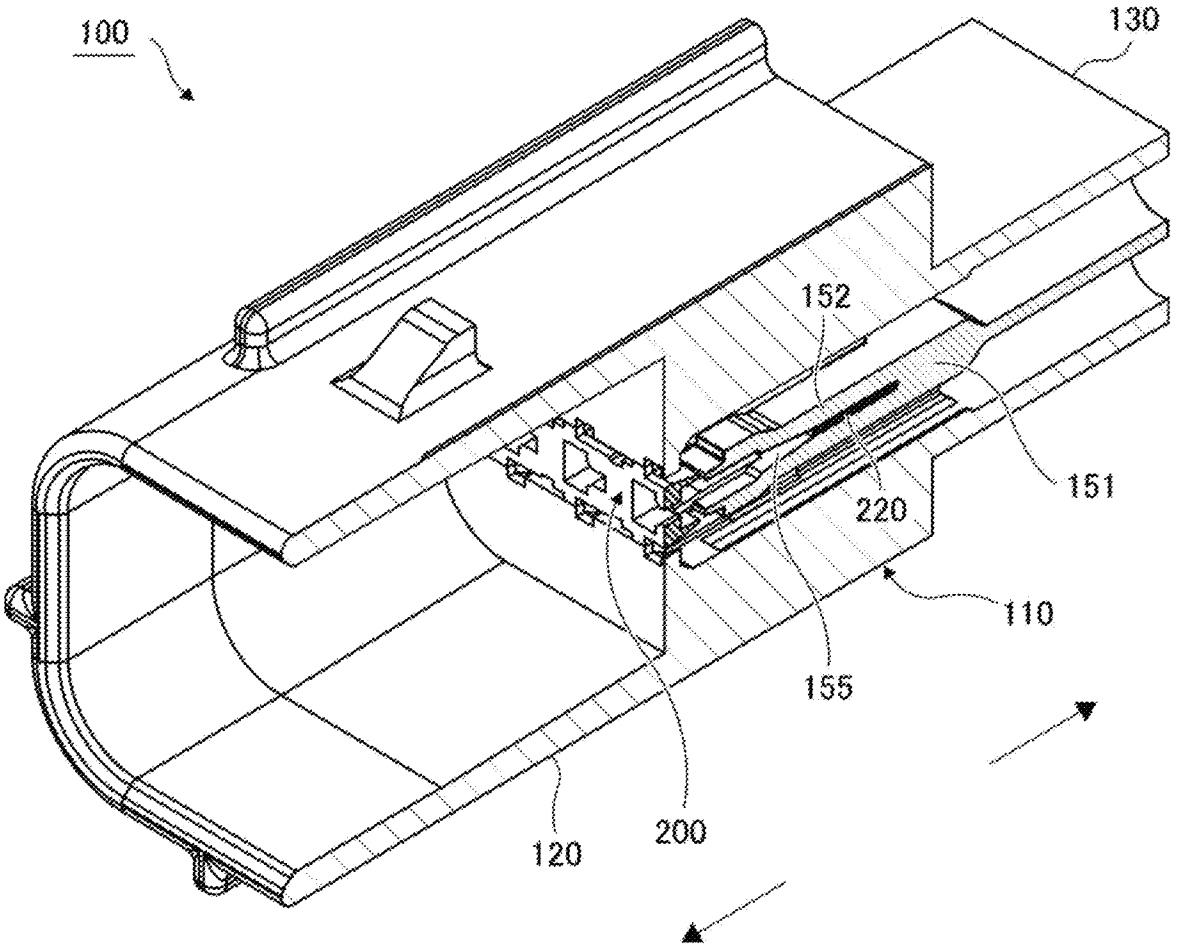
FIG. 7 is a cross-sectional perspective view when a state corresponding to the cross-sectional view in FIG. 3B is obliquely viewed from above when the retainer is attached to the housing of the connector in the embodiment.
Figure 8A:
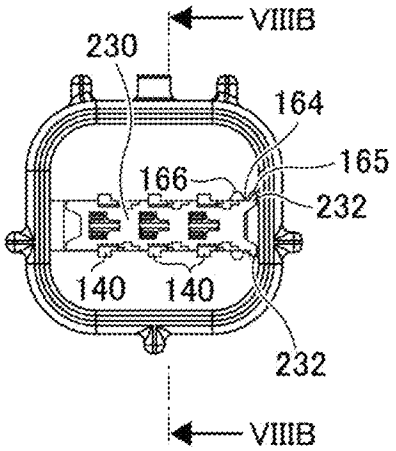
FIG. 8A is a front view when the retainer is attached to the housing of the connector in the embodiment and is viewed from the front side with respect to the mating direction.
Figure 8B:
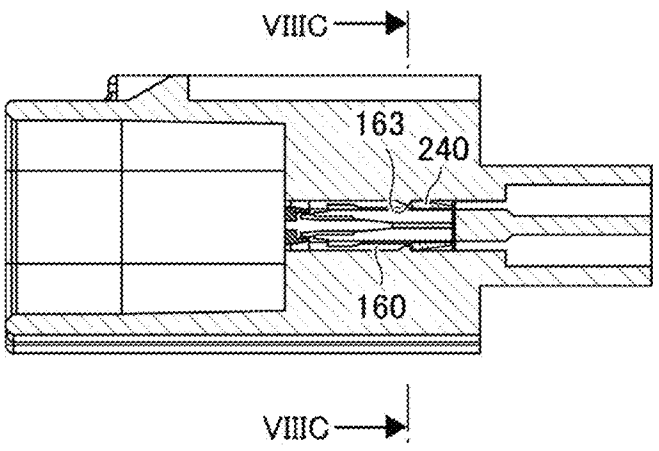
FIG. 8B is a VIIIB-VIIIB line cross-sectional view of FIG. 8A.
Figure 8C:
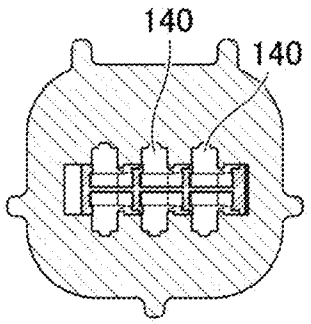
FIG. 8C is a VIIIC-VIIIC line cross-sectional view of FIG. 8B.
Figure 8D:
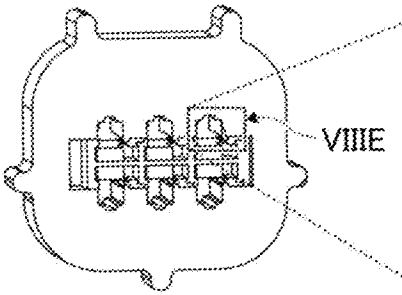
FIG. 8D is a cross-sectional perspective view when a housing main body is thinly cut out by the VIIIC-VIIIC line cross-section in FIG. 8B and is obliquely viewed.
Figure 8E:
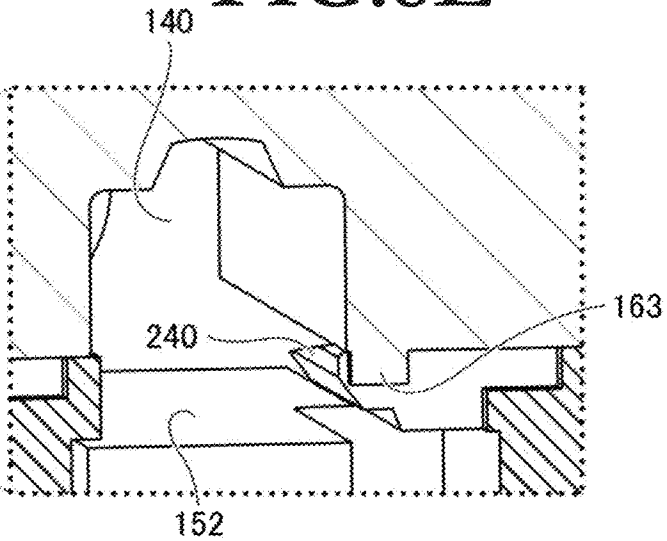
FIG. 8E is a partially enlarged view of a VIIIE portion in FIG. 8D.

Next, an assembly of the connector 10 in the embodiment will be described with reference to FIGS. 7 to 14D. FIG. 7 is a cross-sectional perspective view of a state corresponding to the cross-sectional view in FIG. 3B, and is obliquely viewed from above when the retainer 200 is attached to the housing 100 of the connector 10 in the embodiment. FIG. 8A is a front view when the retainer is attached to the housing of the connector in the embodiment and is viewed from the front side with respect to the mating direction. FIG. 8B is a VIIIB-VIIIB line cross-sectional view of FIG. 8A. FIG. 5C is a VIIIC-VIIIC line cross-sectional view of FIG. 8B. FIG. 5D is a cross-sectional perspective view when a housing main body is thinly cut out by the VIIIC-VIIIC line cross-section in FIG. 8B and is obliquely viewed. FIG. 5E is a partially enlarged view of a VIIIE portion in FIG. 8D.

Firstly, the retainer 200 is attached to the housing main body 110 from the front side with respect to the mating direction, that is, from the connector mating front side toward the rear side with respect to the mating direction. At that time, each insertion wall 210 of the retainer 200 is inserted into the retainer insertion space 160 from the connector mating front side. At this time, the retainer 200 is inserted into the housing main body 110 so that the locking protrusion 232 formed on the front plate 230 of the retainer 200 takes a position in the pre-lock groove 165 formed in the retainer insertion space 160. At this time, since the thickness in the widthwise direction of each insertion wall 210 is thinner than the width of the retainer insertion space 160 with respect to the widthwise direction, each insertion wall 210 of the retainer 200 is located on the left side with respect to the widthwise direction of each retainer insertion space 160.

When the insertion wall 21C) of the retainer 200 is inserted into the retainer insertion space 160 from the connector mating front surface side, as illustrated in FIG. 8B, the locking claws 240 provided on the insertion wall 210 of the retainer 200 are inserted into the retainer insertion space 160. The each locking claw 240 passes over the locking protrusion 163 formed in the retainer insertion space 160 and is engaged thereto. As a result, the locking claw 240 is blocked by the locking protrusion 163 and cannot move forward along the mating direction, and the retainer 200 is prevented from being detached to the mating direction. Further, the locking protrusion 232 formed on the front plate 230 of the retainer 200 is located in the pre-lock groove 165 of the housing main body 110, and movement in the widthwise direction is also prevented by the intermediate protrusion 164. By forming at least one of the locking claw 240 and the locking protrusion 163 so as to have elasticity, as the locking claw 240 gets over the locking protrusion 163, the locking claw 240 easily moves backward along the mating direction. While the backward movement becomes easy, once the locking claw 240 is engaged to the locking protrusion 163, it is difficult or impossible to disengage the locking claw 240 forward with respect to the mating direction.

At this time, as illustrated in FIG. 7, the horizontal connection plate 220 of the retainer 200 is inserted into the lance base 151 side of each elastic arm 152 of the lance 150 adjacent vertically. However, the horizontal connection plate 220 does not exist on the mating front side of each elastic arm 152, and the inter-lance gap 155 remains. Thus, the elastic arms 152 of the upper and lower lances 150 are in a state of being capable of being bent up and down.

Figure 9:
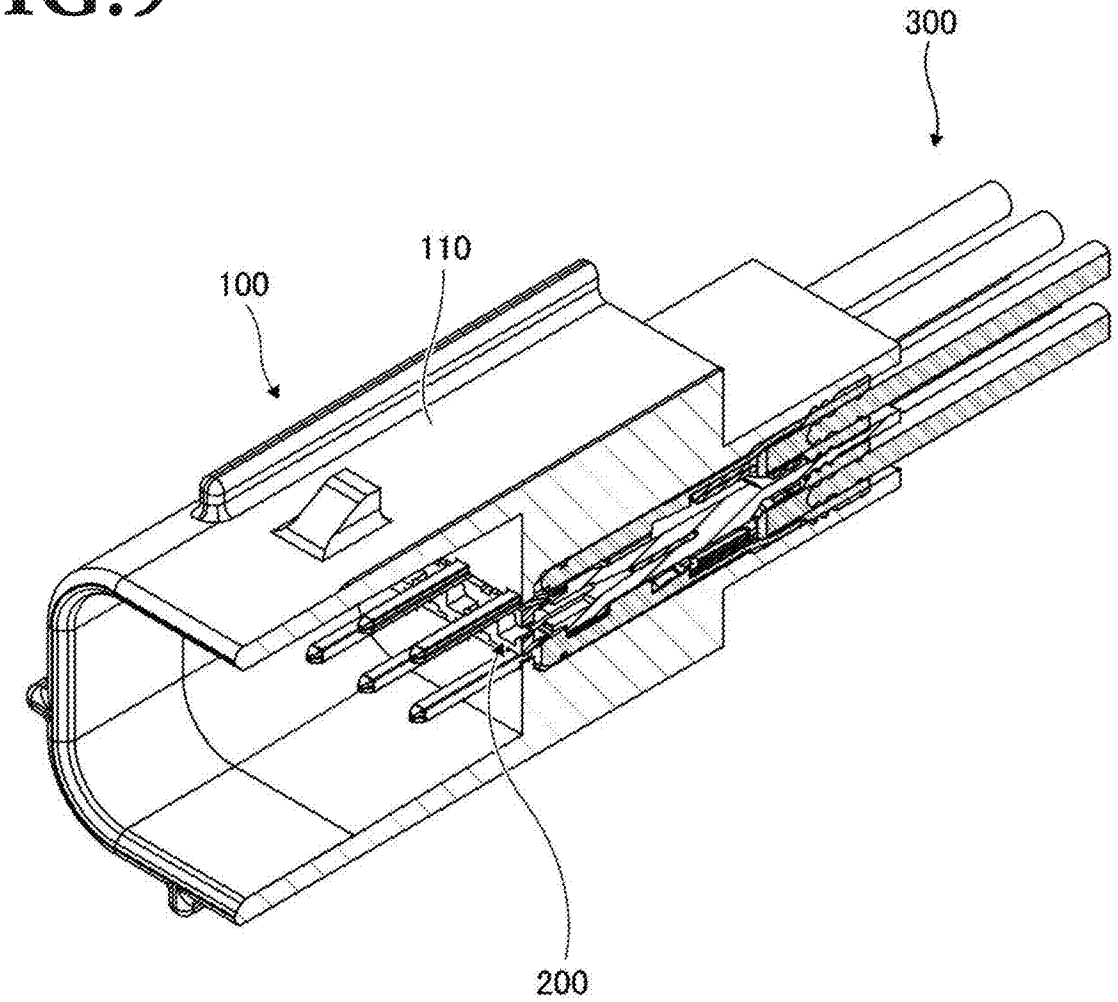
FIG. 9 is a cross-sectional perspective view when a state corresponding to the cross-sectional view in FIG. 3B is obliquely viewed from above when the connector terminal is attached to the connector in a state of FIG. 7.
Figure 10A:
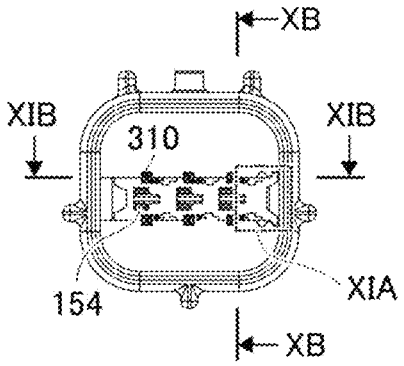
FIG. 10A is a front view when a result obtained when the retainer and the connector terminal are attached to the housing of the connector in the embodiment and a pre-locked state is made is viewed from the front side with respect to the mating direction.
Figure 10B:
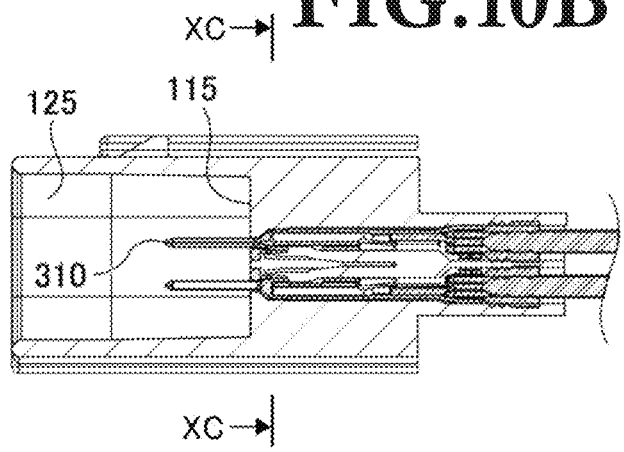
FIG. 10B is a XB-XB line cross-sectional view of FIG. 10A.
Figure 10C:
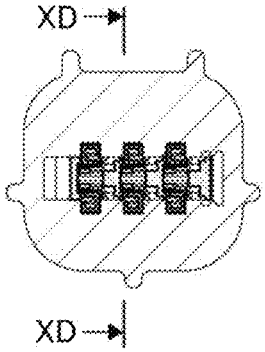
FIG. 10C is a XC-XC line cross-sectional view of FIG. 10B.
Figure 10D:
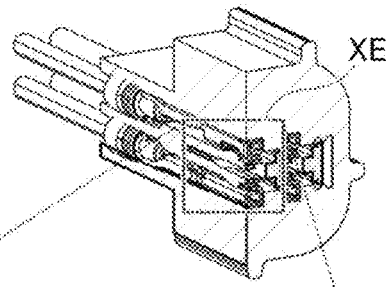
FIG. 10D is a cross-sectional perspective view when
Figure 10E:
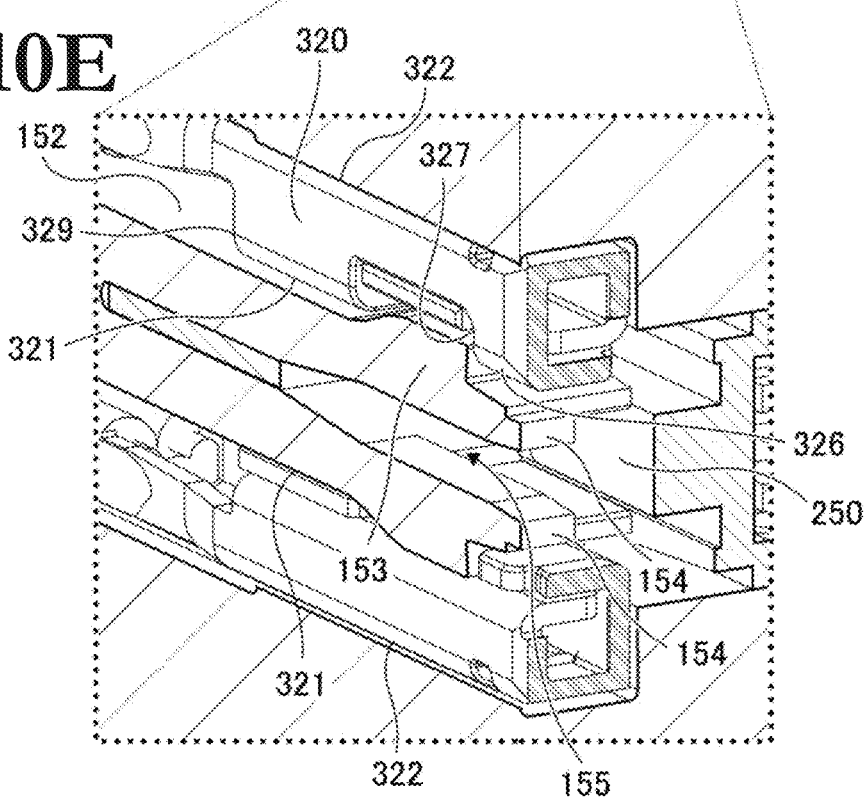
FIG. 10E is a partially enlarged view of an XE portion of FIG. 10D.

In this state, the connector terminal 300 is inserted into the housing 100 from the rear side with respect to the mating direction. The state at this time will be described with reference to FIGS. 9 to 11D. FIG. 9 is a cross-sectional perspective view when a state corresponding to the cross-sectional view in FIG. 3B is obliquely viewed from above when the connector terminal 300 is attached to the connector 10 in a state of FIG. 7. FIG. 10A is a front view when a result obtained when the retainer and the connector terminal are attached to the housing of the connector in the embodiment and a pre-locked state is made is viewed from the front side with respect to the mating direction. FIG. 10B is a XB-XB line cross-sectional of FIG. 10A. FIG. 10C is a XC-XC line cross-sectional view of FIG. 10B. FIG. 10D is a cross-sectional perspective view when FIG. 10C is further taken along XD-XD line and is obliquely viewed. FIG. 10E is a partially enlarged view of an XE portion of FIG. 10D. FIG. 11A is a partially enlarged view of XIA of FIG. 10A, FIG. 11B is a cross-sectional view along XIB-XIB line in FIG. 10A, FIG. 11C is a cross-sectional perspective view when FIG. 11B is obliquely viewed, and FIG. 11D is a partially enlarged view of a D portion of FIG. 11C.

As illustrated in FIGS. 9, 10B, and 11B, the connector terminal 300 is inserted into the terminal accommodation passage 140 of the housing main body 110 from the rear side with respect to the mating direction. Then, the box portion 320 and the connection portion 330 of the connector terminal 300 are accommodated in the terminal accommodation passage 140, and the contact 310 protrudes from the mating front surface 115 into the fitting opening 125. The connector terminal 300 is inserted into the upper terminal accommodation passage 140U in a state where the box lower surface 322 of the box portion 320 is turned upside down and the box upper surface 321 is turned down. The connector terminal 300 is inserted into the lower terminal accommodation passage 140L so that the box upper surface 321 of the box portion 320 is on the upper side and the box lower surface 322 is on the lower side.

When the box portion 320 of the connector terminal 300 is inserted into the terminal accommodation passage 140, the tall portion 326 of the box upper surface 321 contacts the lance locking protrusion 153 of the lance 150. When the connector terminal 300 is moved forward along the mating direction in the terminal accommodation passage 140, the tall portion 326 deflects the elastic arm 152 in the vertical direction against the urging force in the vertical direction of the elastic arm 152 of the lance 150. When the tall portion 326 passes beyond the lance locking protrusion 153 to the forward direction with respect to the mating direction, the lance locking protrusion 153 returns to the previous state, and the lance locking protrusion 153 is engaged with the front locking step 327 formed on the box upper surface 321 of the box portion 320. This prevents the connector terminal 300 from moving rearward with respect to the mating direction within the terminal accommodation passage 140 of the housing 100.

At this time, the inclined box surface 328 of the box portion 320 abuts on the accommodation passage inclined surface 141 immediately adjacent to the mating front surface 115 of the terminal accommodation passage 140 so that the connector terminal 300 cannot move further forward with respect to the mating direction.

At this time, that is, when the retainer 200 is in the pre-locked position, as illustrated in FIG. 10E, the restriction protrusion 250 of the retainer 200 is not interposed between the elastic arms 152 of the upper and lower lances 150. In other words, the lance 150 can be bent vertically, that is, the upper lance 150U can be bent downward and the lower lance 150L can be bent upward. As illustrated in FIG. 11A, the operation piece 154 of the elastic arm 152 is visible through the tool insertion opening 231 of the front plate 230 of the retainer 200. A flat tool can be inserted into the tool insertion opening 231, thereby the upper lance 150U can be moved downward or the lower lance 1501, can be moved upward to release the engagement between the lance locking protrusion 153 of the elastic arm 152. Thus, the front locking step 327 of the connector terminal 300, and the connector terminal 300 can be moved backward along the mating direction. Therefore, the state of FIGS. 10 and 11 is referred to as a pre-locked state of the connector terminal 300.

Further, in this pre-locked state, as illustrated in FIGS. 11C and 11D, the locking claw 240 of the retainer 200 is formed so as to protrude into the retainer insertion space 160 of the housing main body 110. The locking protrusion 163 is engaged, and the forward movement of the retainer 200 along the mating direction is restricted. Note that the locking claw 240 of the retainer 200 does not reach the rear-side locking step 329 of the box portion 320 of the connector terminal 300 and is not locked. When the elastic arm 152 of the lance is moved up or down by operating the operation piece 154 of the lance ISO. The engagement between the lance locking protrusion 153 and the front locking step 327 of the box portion 320 is released; thereby the connector terminal 300 can be pulled out from the terminal accommodation passage 140 toward the rearward direction along the mating direction.

Figure 12:
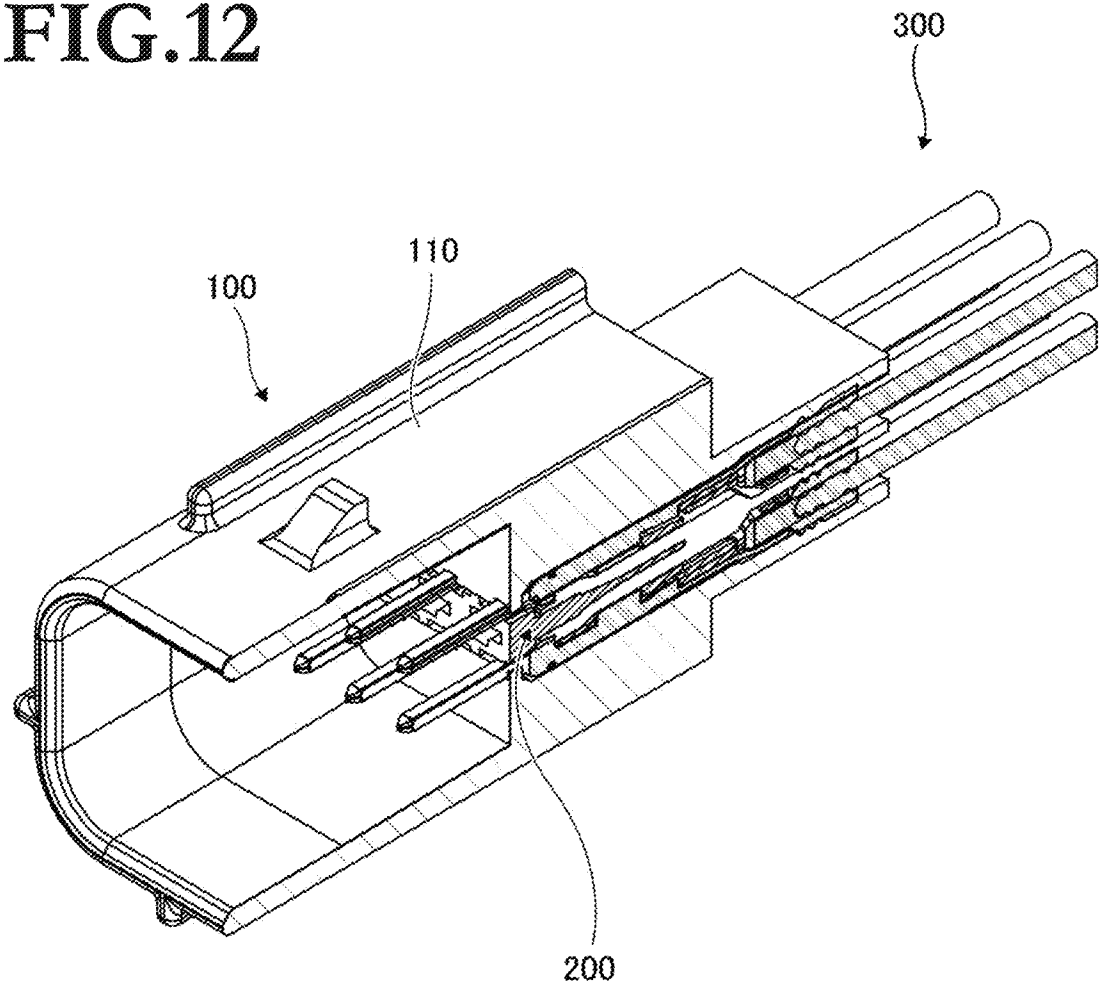
FIG. 12 is a cross-sectional perspective view when a state corresponding to the cross-sectional view of FIG. 3B is obliquely viewed from above when the retainer is moved to a full-locked position in the connector in FIG. 9, and then the connector is in a full-locked state.
Figure 13A:
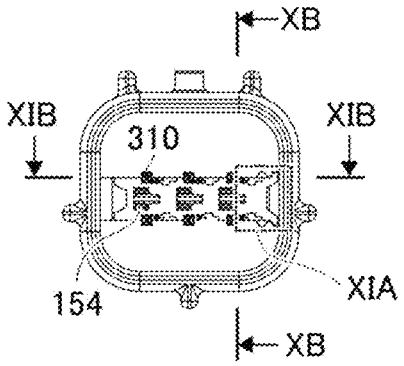
FIG. 13A is a front view when a result obtained when the retainer and the connector terminal are attached to the housing of the connector in the embodiment, and thus a full-locked state is made is viewed from the front with respect to the mating direction.
Figure 13B:
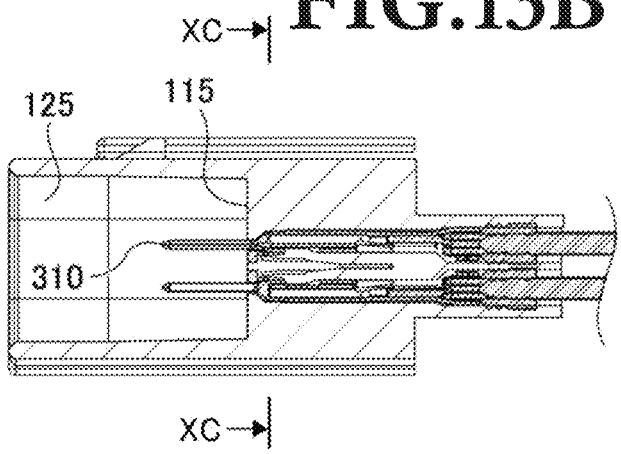
FIG. 13B is a XIIIB-XIIIB line cross-sectional view of FIG. 13A.
Figure 13C:
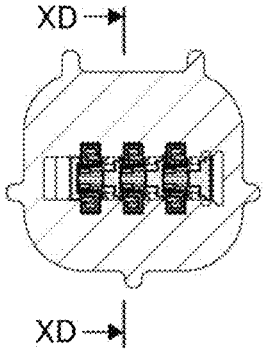
FIG. 13C is a XIIIC-XIIIC line cross-sectional view of FIG. 13B.
Figure 13D:
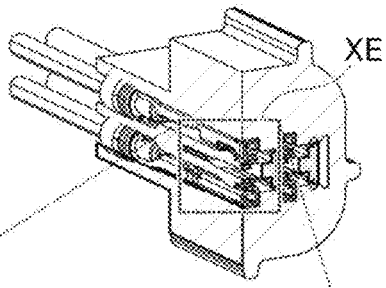
FIG. 13D is a cross-sectional perspective view when
Figure 13E:
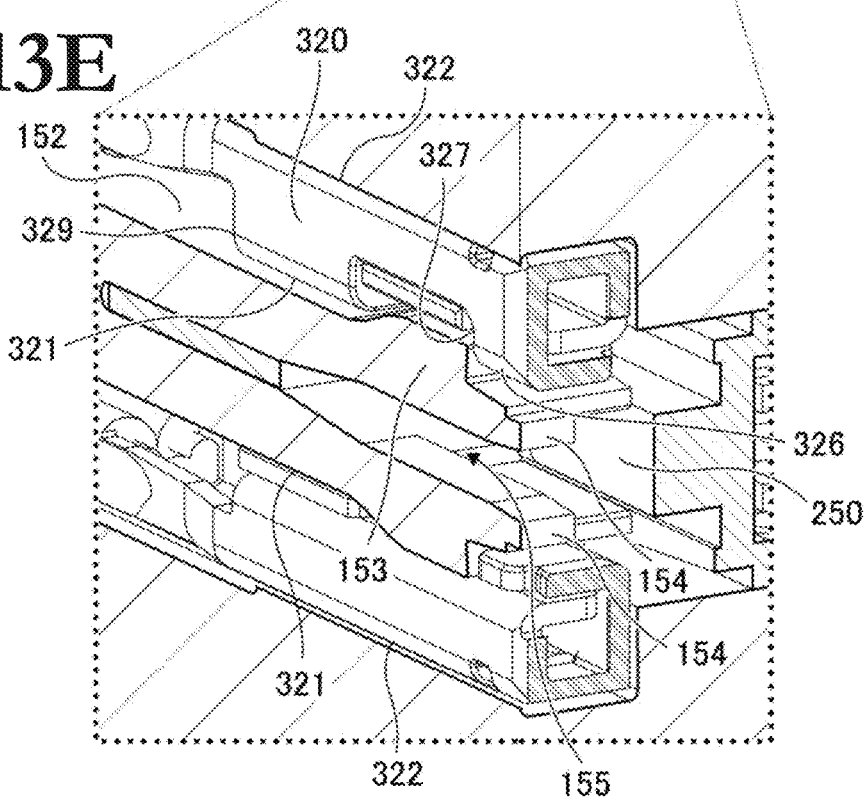
FIG. 13E is a partially enlarged view of an XIIIE portion of FIG. 13D.

Next, the connector 10 of the present embodiment in the full-locked state will be described with reference to FIGS. 12 to 14D. FIG. 12 is a cross-sectional perspective view when a state corresponding to the cross-sectional view of FIG. 3B is obliquely viewed from above when the retainer 200 is moved to a full-locked position in the connector in FIG. 9, and then the connector 10 is in a full-locked state. FIG. 13A is a front view when a result obtained when the retainer and the connector terminal are attached to the housing of the connector in the embodiment, and thus a full-locked state is made is viewed from the front side with respect to the mating direction. FIG. 13B is a XIIIB-XIIIB line cross-sectional view of FIG. 13A. FIG. 13C is a XIIIC-XIIIC line cross-sectional view of FIG. 13B. FIG. 13D is a cross-sectional perspective view when FIG. 13C is further taken along line and is obliquely viewed. FIG. 13E is a partially enlarged view of an XIIIE portion of FIG. 13D. FIG. 14A is a partially enlarged view of XIVA of FIG. 13A. FIG. 14B is a cross-sectional view along XIVB-XIVB line in FIG. 13A. FIG. 14C is a cross-sectional perspective view when FIG. 14B is obliquely viewed. FIG. 14D is a partially enlarged view of a XIVD portion of FIG. 14C.

After the connector terminal 300 is inserted into the terminal accommodation passage 140 from the rear side with respect to the mating direction so that the connector terminal 300 is pre-locked as illustrated in FIGS. 9, 10A, and 11A, the retainer 200 is moved in the widthwise direction (leftward direction), thereby the full-locked position as illustrated in FIGS. 12, 13A, and 14A is obtained. At this time, the locking protrusion 232 formed on the front plate 230 of the retainer 200 moves from the pre-lock groove 165 to the full-lock groove 166 overcoming the intermediate protrusion 164 and is engaged with the full-lock groove 166.

Further, at this time, as illustrated in FIG. 13E, the lance locking protrusion 153 of the lance 150 is engaged to the front locking step 327 formed on the box upper surface 321 of the box portion 320 as in the pre-locked state described above. Further, at this time, that is, when the retainer 200 is at the full-locked position, the restriction protrusion 50 of the retainer 200 moves in the widthwise direction (leftward direction) and is inserted into the inter-lance gap 155 between the elastic arms 152 of the upper and lower lances 150. That is, the restriction protrusion 250 is located above or below the elastic arm 152 of the lance 150. Although FIG. 13E shows an example in which the restriction protrusion 250 is inserted into a part of the inter-lance gap 155 with respect to the widthwise direction, it may be fully inserted into the inter-lance gap 155. Thereby, the vertical bending of the elastic arm 152 of the lance 150 is restricted. That is, it is not possible to bend the elastic arm 152 up and down, and thus it is not possible to release the engagement between the lance locking protrusion 153 and the front locking step 327.

Further, as illustrated in FIG. 14A, when the retainer 200 is moved in the widthwise direction, the tool insertion opening 231 is also moved in the widthwise direction from a front position of the operation piece 154 of the lance 150 with respect to the mating direction. As a result, the operation piece 154 is hidden by the closed portion 233 of the tool insertion opening 231 when viewed from the front side with respect to the mating direction, and thus it is not possible to insert a tool or the like into the tool insertion opening 231 for accessing the operation piece 154. Therefore, it is not possible to release the above-described engagement between the lance locking protrusion 153 of the elastic arm 152 and the front locking step 327 of the connector terminal 300 and to pull the connector terminal 300 backward along the mating direction.

Further, in this state, as illustrated in FIGS. 14C and 14D, the locking claw 240 of the retainer 200 moves in the widthwise direction. And the locking claw 240, maintaining the engaging state with the locking protrusion 163 formed to protrude into the retainer insertion space 160 of the housing main body 110, reaches the rear-side locking step 329 formed on the rear side of the box portion 320 of the connector terminal 300, which is further located on the widthwise direction side. Thus the locking claw 240 come to be engaged with the rear-side locking step 329. As a result, an occurrence of a situation in which the box portion 320 of the connector terminal 300 is detached backward along the mating direction is prevented, and thus it is not possible to pull out the connector terminal 300 from the terminal accommodation passage 140 along the mating direction.

The connector 10 in the embodiment of the present invention has been described above with reference to the drawings. The connector 10 in the embodiment has a so-called male connector structure, however, the similar principle can also be applied to a female connector.

What is claimed is:

1. A connector comprising:

a housing including an accommodation passage configured to extend along a connector mating direction and accommodate a connector terminal, and a retainer insertion space configured to communicate with the accommodation passage in a widthwise direction and open to a connector mating front side and a retainer including an insertion wall configured to extend along the connector mating direction so as to correspond to a shape of the retainer insertion space, and a locking claw configured to protrude from a rear portion of the insertion wall with respect to the connector mating direction toward the accommodation passage, wherein the housing is provided with a locking protrusion configured to protrude in a vertical direction at a rear portion of the retainer insertion space with respect to the mating direction, when the retainer is inserted from the connector mating front side into the retainer insertion space, the locking claw gets over the locking protrusion to be engaged therewith, and thus a pre-locked position at which detachment of the retainer to the front side with respect to the mating direction is prevented is obtained, and when the connector terminal is inserted into the accommodation passage from the rear side with respect to the mating direction, and then the retainer is moved in the widthwise direction, a full-locked position at which the locking claw of the retainer engages with a step formed in the rear portion of the connector terminal with respect to the connector mating direction, and detachment of the connector terminal toward the rear side with respect to the mating direction is prevented is obtained.

2. The connector according to claim 1, wherein at least one of the locking claw and the locking protrusion has elasticity.

3. The connector according to claim 1, wherein the locking claw has a shape that tapers toward the rear side with respect to the connector mating direction, and/or the locking protrusion has an inclined surface on the front side with respect to the connector mating direction.

4. The connector according to claim 1, wherein the housing includes a lance in the accommodation passage, the lance extending along the connector mating direction, being engaged with a locking portion formed in the front side of the connector terminal accommodated in the accommodation passage, with respect to the connector mating direction, and being capable of bending toward the vertical direction, the insertion wall of the retainer includes a restriction protrusion configured to protrude toward the widthwise direction of the connector, and when the retainer is at the pre-locked position, bending of the lance toward the vertical direction is not restricted in a manner that the restriction protrusion is not at a position of the lance in the vertical direction, and when the retainer is at the full-locked position, bending of the lance toward the vertical direction is restricted in a manner that the restriction protrusion is at the position of the lance in the vertical direction.

5. The connector according to claim 4, wherein an insertion opening is provided on a mating front side of the retainer for allowing an insertion of a tool for releasing locking between the locking portion of the connector terminal and the lance, and a closing portion is formed in the insertion opening for preventing the insertion of the tool by closing a mating front side of the restriction protrusion.

* * * * *